US010883469B1

(12) United States Patent
Leedy et al.

(10) Patent No.: US 10,883,469 B1
(45) Date of Patent: Jan. 5, 2021

(54) IGNITION INTERRUPTER AND RELATED METHODS

(71) Applicant: Zombiebox International LLC, Mesa, AZ (US)

(72) Inventors: Timothy David Leedy, Mesa, AZ (US); Jay Patel, Mesa, AZ (US)

(73) Assignee: Zombiebox International LLC, Mesa, AZ (US)

( * ) Notice: Subject to any disclaimer, the term of this patent is extended or adjusted under 35 U.S.C. 154(b) by 68 days.

(21) Appl. No.: 16/359,679

(22) Filed: Mar. 20, 2019

Related U.S. Application Data

(60) Provisional application No. 62/645,325, filed on Mar. 20, 2018.

(51) Int. Cl.
*H01H 37/54* (2006.01)
*F02P 7/077* (2006.01)
*F02P 11/00* (2006.01)

(52) U.S. Cl.
CPC ..... *F02P 7/077* (2013.01); *F02P 11/00* (2013.01); *H01H 37/54* (2013.01); *H01H 37/5409* (2013.01)

(58) Field of Classification Search
CPC ..... F02P 7/077; F02P 11/00; H01H 37/54; H01H 37/5409; H01H 2037/5445
See application file for complete search history.

(56) References Cited

U.S. PATENT DOCUMENTS

| | | | | |
|---|---|---|---|---|
| 1,712,221 | A | 5/1929 | Larsson | |
| 2,917,662 | A | 12/1959 | Cunningham | |
| 3,100,246 | A | 8/1963 | Riley | |
| 2007/0217106 | A1* | 9/2007 | Lagnoux | H01C 7/126 361/91.1 |
| 2014/0292472 | A1* | 10/2014 | Qin | H01H 89/00 337/5 |
| 2015/0357138 | A1* | 12/2015 | Kamiyama | H01H 37/34 337/350 |
| 2017/0110279 | A1* | 4/2017 | Yang | H01C 7/102 |
| 2018/0175539 | A1* | 6/2018 | Bhosale | H01R 13/4534 |

* cited by examiner

*Primary Examiner* — Jacob R Crum
(74) *Attorney, Agent, or Firm* — Adam R. Stephenson, LTD.

(57) ABSTRACT

A system for interrupting ignition is disclosed. Specific implementations of ignition interrupters may include a first conductive tab configured to couple to a spark plug; a second conductive tab configured to couple to a spark plug wire; a first tab holder coupled with the first conductive tab; a second tab holder coupled with the second conductive tab, where the second conductive tab overlaps with the first conductive tab; a sled positioned perpendicularly to a plane of the first conductive tab and the second conductive tab, the sled coupled between the first conductive tab and the second conductive tab; a first spring coupled to the sled; and a second spring coupled to the sled; where the sled may be configured to move to an open position in the gap between the first conductive tab and the second conductive tab, decompressing the first spring and the second spring.

17 Claims, 10 Drawing Sheets

IGNITION INTERRUPTER AND RELATED METHODS

CROSS REFERENCE TO RELATED APPLICATIONS

This document claims the benefit of the filing date of U.S. Provisional Patent Application 62/645,325, entitled "Ignition Interrupter and Related Methods" to Leedy, et al. which was filed on Mar. 20, 2018, the disclosure of which is hereby incorporated entirely herein by reference.

BACKGROUND

1. Technical Field

Aspects of this document relate generally to devices and methods for controlling the operation of motors, such as the ignition, or interruption of the ignition, of internal combustion motors, spark plugs, and electrical circuits not otherwise used in internal combustion motors.

2. Background

A spark plug operates by receiving voltage at a terminal of the spark plug. Spark plugs may be used in combustion engines to ignite compressed fuel and power a motor. Spark plug interrupters may include devices and methods of interrupting the ignition within the actual spark plug.

SUMMARY

Implementations of ignition interrupters may include: a first conductive tab having a first end and a second end. The first end may be configured to couple to a spark plug. The ignition interrupter may also include a second conductive tab having a first end and a second end. The first end may be configured to couple to a spark plug wire. The ignition interrupter may also include a first tab holder coupled with the first end of the first conductive tab. The first tab holder may be coupled to a base. The ignition interrupter may also include a second tab holder coupled with the first end of the second conductive tab. The second tab holder may be coupled to the base. A second end of the second conductive tab may overlap with the second end of the first conductive tab. Ignition interrupters may also include a sled having a first end and a second end. The sled may be positioned perpendicularly to a plane of the first conductive tab and the second conductive tab. The sled may be coupled between the first conductive tab and the second conductive tab. Ignition interrupters may also include a first spring coupled to the first end of the sled and a second spring coupled to the second end of the sled. The sled may be configured to move to an open position in the gap between the first conductive tab and the second conductive tab, decompressing the first spring and the second spring.

Implementations of ignition interrupters may include one, all, or any of the following:

Ignition interrupters may further include a snapdisc included on a side of the base opposite the first tab holder and the second tab holder and a pin coupled with the snapdisc extending through the base. The pin may be coupled with the second end of the second conductive tab and may extend through an opening in the first conductive tab. The snapdisc may be configured to raise the pin when exposed to a predetermined temperature. The snapdisc may create a gap between the first conductive tab and the second conductive tab.

Ignition interrupters may further include a conductive portion of the sled that interrupts electrical connection of the first conductive tab with the second conductive tab when the sled is in the open position.

The sled may be configured to move to a closed position out of the gap between the first conductive tab and the second conductive tab, compressing the first spring and the second spring.

A conductive portion of the sled may electrically connect the first conductive tab with the second conductive tab when the sled is in the closed position.

Ignition interrupters may further include a reset tab coupled to the sled. The reset tab may be configured to move the sled to a closed position out of the gap between the first conductive tab and the second conductive tab, compressing the first spring and the second spring.

Ignition interrupters may further include a molded housing. The molded housing may be positioned around at least the base, the first conductive tab, and the second conductive tab.

Implementations of ignition interrupters may include: a first conductive tab having a first end and a second end. The first end may be configured to couple to a spark plug. Ignition interrupters may further include a second conductive tab having a first end and a second end. The first end may be configured to couple to a spark plug wire. Ignition interrupters may further include a first tab holder coupled with the first end of the first conductive tab. The first tab holder may be coupled to a base. Ignition interrupters may further include a second tab holder coupled with the first end of the second conductive tab. The second tab holder may be coupled to the base. A second end of the second conductive tab may overlap with the second end of the first conductive tab. Ignition interrupters may further include a snapdisc on a side of the base opposite the first tab holder and the second tab holder. Ignition interrupters may also include a pin coupled with the snapdisc extending through the base. The pin may be coupled with the second end of the second conductive tab. The pin may extend through an opening in the first conductive tab. Ignition interrupters may also include a sled having a first end and a second end. The sled may be positioned perpendicularly to a plane of the first conductive tab and the second conductive tab. The sled may be coupled between the first conductive tab and the second conductive tab. Ignition interrupters may also include a first spring coupled to the first end of the sled and a second spring coupled to the second end of the sled. The snapdisc may be configured to raise the pin when exposed to a predetermined temperature creating a gap between the first conductive tab and the second conductive tab. The sled may be configured to move to an open position in the gap between the first conductive tab and the second conductive tab decompressing the first spring and the second spring.

Implementations of ignition interrupters may include one, all, or any of the following:

A conductive portion of the sled may interrupt an electrical connection of the first conductive tab with the second conductive tab when the sled is in the open position.

The sled may be configured to move to a closed position out of the gap between the first conductive tab and the second conductive tab. The sled may compress the first spring and the second spring.

A conductive portion of the sled may electrically connect the first conductive tab with the second conductive tab when the sled is in the closed position.

Ignition interrupters may also include a reset tab coupled to the sled. The reset tab may be configured to move the sled to a closed position out of the gap between the first conductive tab and the second conductive tab, compressing the first spring and the second spring.

Ignition interrupters may also include a molded housing. The molded housing positioned around at least the base, the first conductive tab, and the second conductive tab.

The snapdisc may be made of a thermally sensitive material.

Implementations of ignition interrupters may include: a first conductive tab having a first end and a second end. The first end may be configured to couple to a spark plug. Ignition interrupters may also include a second conductive tab having a first end and a second end. The first end may be configured to couple to a spark plug wire. Ignition interrupters may also include a first tab holder coupled with the first end of the first conductive tab. The first tab holder may be coupled to a base. Ignition interrupters may also include a second tab holder coupled with the first end of the second conductive tab. The second tab holder may be coupled to the base. A second end of the second conductive tab may overlap with the second end of the first conductive tab. Ignition interrupters may also include a sled having a first end and a second end. The sled may be positioned perpendicularly to a plane of the first conductive tab and the second conductive tab. The sled may be coupled between the first conductive tab and the second conductive tab. A first spring may be coupled to the first end of the sled. A second spring may be coupled to the second end of the sled. A reset tab may be coupled to the sled. The reset tab may be configured to move the sled to a closed position out of the gap between the first conductive tab and the second conductive tab, compressing the first spring and the second spring. The sled may be configured to move to an open position in the gap between the first conductive tab and the second conductive tab, decompressing the first spring and the second spring.

Implementations of ignition interrupters may include one, all, or any of the following:

A snapdisc included on a side of the base opposite the first tab holder and the second tab holder and a pin coupled with the snapdisc extending through the base. The pin may be coupled with the second end of the second conductive tab and may extend through an opening in the first conductive tab. The snapdisc may be configured to raise the pin when exposed to a predetermined temperature creating a gap between the first conductive tab and the second conductive tab.

A conductive portion of the sled may interrupt an electrical connection of the first conductive tab with the second conductive tab when the sled is in the open position.

The sled may be configured to move to a closed position out of the gap between the first conductive tab and the second conductive tab, compressing the first spring and the second spring.

A conductive portion of the sled may electrically connect the first conductive tab with the second conductive tab when the sled is in the closed position.

Ignition interrupters may also include a molded housing. The molded housing may be positioned around at least the base, the first conductive tab, and the second conductive tab.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

Implementations will hereinafter be described in conjunction with the appended drawings, where like designations denote like elements, and.

DESCRIPTION

This disclosure, its aspects and implementations, are not limited to the specific components, assembly procedures or method elements disclosed herein. Many additional components, assembly procedures and/or method elements known in the art consistent with the intended ignition interrupters will become apparent for use with particular implementations from this disclosure. Accordingly, for example, although particular implementations are disclosed, such implementations and implementing components may comprise any shape, size, style, type, model, version, measurement, concentration, material, quantity, method element, step, and/or the like as is known in the art for such ignition interrupters, and implementing components and methods, consistent with the intended operation and methods.

A spark plug operates by receiving voltage at a terminal of the spark plug. The spark plug typically includes a gap between a center electrode and a ground electrode. Initially, no current can flow between the center electrode and the ground electrode as the gases between the two act as an insulator. However, as voltage builds up within the center electrode, the structure of the gases between the center electrode and the ground electrode begin to change. As the voltage exceeds the dielectric strength of the gases, the gases become ionized and allow current to flow across the gap producing the spark. Spark plugs have been used in combustion engines to ignite compressed fuel and power a motor.

Spark plug interrupters have included devices and methods of interrupting the ignition within the actual spark plug. Various examples include devices having conductive fuses within the actual spark plug device which melt to break the conductive path within the spark plug, or actual detonations within the spark plug which interrupt the conductive path within the spark plug.

Disclosed herein is a system and methods for an ignition interrupter which is universal, in-line with a spark plug and not actually part of the spark plug, user resettable and/or reusable, and thermally activated. Particular implementations of the ignition interrupters disclosed herein may be used with spark plugs used in, by non-limiting example, generators, cars, machinery, or any other system including an internal combustion engine, or electrical circuits not otherwise used in internal combustion motors.

Figure 1:
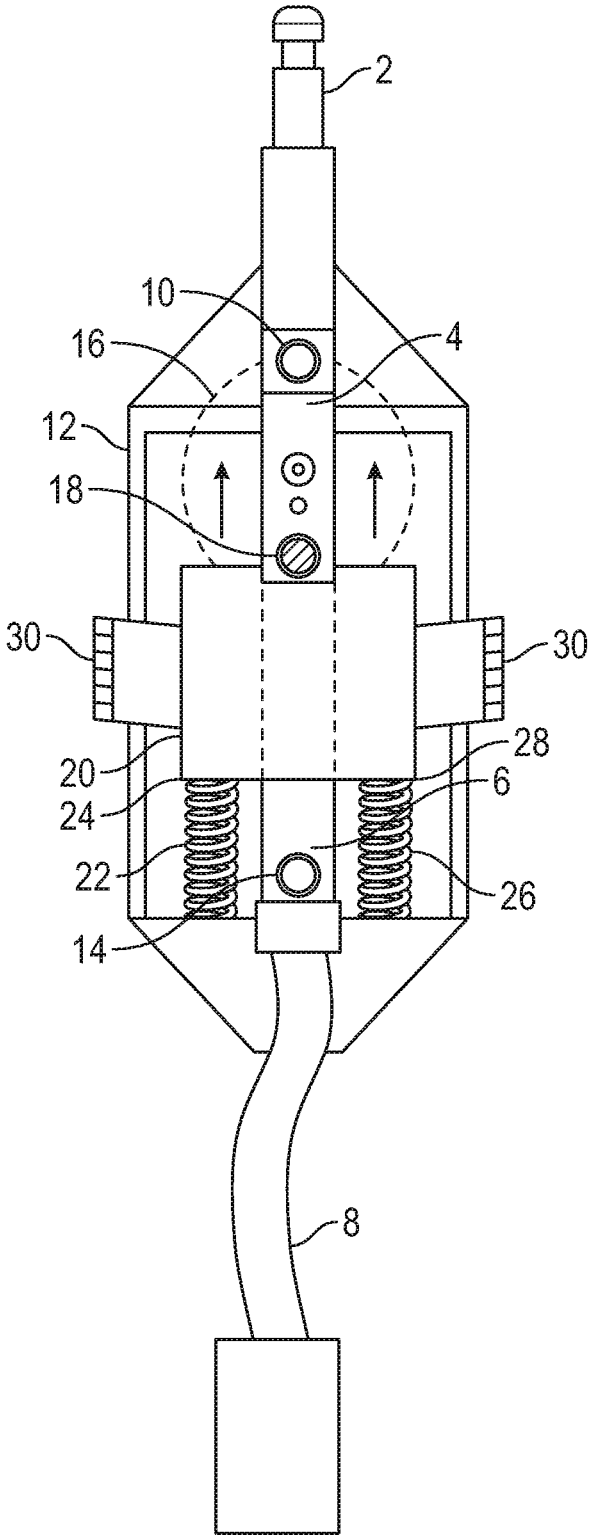
FIG. 1 illustrates a top view of an implementation of an ignition interrupter.

Referring to FIG. 1, a top view of an implementation of an ignition interrupter is illustrated. As illustrated, the ignition interrupter may include a spark plug terminal 2 configured to couple to a spark plug, or other ignition device. The spark plug terminal 2 may be made of any conductive material, and in particular implementations, may be the same as or similar to the terminals used on spark plugs. In various implementations, the shape of the spark plug terminal 2 may match the shape of the terminal of the spark plug which the ignition interrupter is configured to interrupt. As illustrated, a first conductive tab 4 may be coupled to the spark plug terminal 2. In various implementations, by non-limiting example, the first conductive tab 4 may run parallel with, and overlap with, a second conductive tab 6. In other implementations, the first conductive tab 4 and the second conductive tab 6 may be positioned perpendicularly, or in any other position where they overlap, or connect at any point in order to complete an electrical connection. As illustrated, the second conductive tab 6 may be configured to couple with a spark plug wire 8. Similar to the spark plug terminal 2, a terminal end of the spark plug wire 8 may be shaped and configured to receive a terminal of the spark plug which the spark plug interrupter is configured to interrupt. The first conductive tab and the second conductive tabs may be formed of copper, nickel, and other conductive materials.

In various implementations, the spark plug terminal 2 of the ignition interrupter may be configured to be compatible with many different types of motor systems. Similarly, the terminal end of the spark plug wire 8 may be configured to receive many different types of terminal designs used for various spark plugs. In this manner, the ignition interrupter may be designed to be used universally as a signal interrupter, and may be compatible with various systems and types of spark plugs. In particular implementations, the spark plug terminal 2 of the ignition interrupter may be configured to be compatible with motor systems of generators and the terminal end of the spark plug wire 8 may be configured to receive terminals of spark plugs used with generator systems. The ignition interrupter is configured to be used in-line with spark plugs. Conventional spark plug interrupters have always interrupted the spark within the actual spark plug, or at a spark controller or distributor. In contrast, the ignition interrupter disclosed herein may be added to existing systems between the terminal of the spark plug and the electrode of the system configured to contact the terminal of the spark plug. An in-line system, such as those disclosed herein, may eliminate the need to manufacture new spark plugs, or install complicated controls or additional sensors and electronics, as the interrupter can be added to any existing system and may interrupt any existing spark plug based on, among other factors, ambient air temperature near the spark plug.

Still referring to FIG. 1, the first conductive tab 4 may be coupled to a base 12 by a first tab holder 10, and the second conductive tab 6 may be coupled to the base 12 by a second tab holder 14. In various implementations, by non-limiting example, the first conductive tab 4 and the second conductive tab 6 may be held in place by any other method of attachment or coupling, including coupling directly with the base 12.

Still referring to FIG. 1, a snapdisc 16 may be included in the ignition interrupter and may be coupled to a side of the base 12 opposite the first tab holder 10 and the second tab holder 14. In various implementations, the snapdisc 16 may be circular in shape, rectangular, or any other shape. As illustrated, a pin 18 may be coupled with the snapdisc 16. In various implementations, by non-limiting example, the pin may extend through the base 12 and couple with a second end 44 of the second conductive tab 6, and extend through an opening in the first conductive tab 4. As illustrated, the ignition interrupter may include a sled 20. In various implementations, the sled 20, or breaker, is a non-conductive material which includes a conductive portion therein. In various implementations, by non-limiting example, the sled 20 may include a first end 24 and a second end 28. As illustrated, the sled 20 may be positioned substantially perpendicular to a plane of the first conductive tab 4 and the second conductive tab 6. As illustrated, the sled 20 may be coupled between the first conductive tab 4 and the second conductive tab 6. In various implementations, the sled 20 may be configured to move along a plane parallel with the first conductive tab 4 and the second conductive tab 6 to an open position in a gap between the first conductive tab 4 and the second conductive tab 6, decompressing a first spring 22 and a second spring 26. In various implementations, the movement of the sled 20 to the open position may break an electrical connection between the first conductive tab 4 and the second conductive tab 6, by creating a gap between the first conductive tab 4 and the second conductive tab 6, thereby preventing the flow of voltage through the spark plug terminal 2 and the spark plug wire 8. In various implementations, the first conductive tab 4 and the second conductive tab 6, when touching, may allow the flow of voltage between the first conductive tab 4 and the second conductive tab 6, when the sled 20 is in a closed position, and there is no gap between them. By bridging the gap within the conductive tabs, a complete conductive path may be formed between the spark plug terminal 2 and the spark plug wire 8, and in turn, voltage applied from a battery (or other power source) may be received by a spark plug. In various implementations, when the sled 20 is moved to the closed position, the first spring 22 and the second spring 26 may be compressed.

In other implementations, the sled 20 may move in any other direction to break the circuit between the spark plug terminal 2 and the spark plug wire 8. Such a movement may include, by non-limiting example, sliding perpendicular to the first conductive tab 4 and the second conductive tab 6, rather than parallel to the conductive tabs, or rotating a conductive portion of the sled 20 into an open/broken position. In particular implementations, only a conductive portion of the sled 20 may move to open/break the conductive path. In still other implementations, rather than breaking the conductive path by physically moving a conductive portion of the sled 20, the conductive path may be broken through changing the conductive properties of the conductive portion, or by interrupting the conductive path using any other method or technique.

Still referring to FIG. 1, as illustrated, the ignition interrupter may include at least one reset tab 30. In various implementations, by non-limiting example, the reset tab 30 may be coupled to the sled 20, on one end of the sled 20, on either end of the sled 20, or on any other location on or along the sled 20. In various implementations, the reset tab 30 may be configured to move the sled 20 to the closed position out of the gap between the first conductive tab 4 and the second conductive tab 6, where the movement compresses the first spring 22 and the second spring 26. In various implementation, the reset tab 30 may be used to reset the ignition interrupter, or to move the sled 20 back into the closed position after the system has been triggered to break the electrical connection, thereby restoring the flow, or the ability of the electricity to flow, between the spark plug terminal and the spark plug wire by way of the first conductive tab 4 and the second conductive tab 6. In this way, the same ignition interrupter may be used multiple times, even after it has been triggered to break the electrical connection and move to the open position. In various implementations, by non-limiting example, the reset tab 30 may be triggered, moved, or caused to move, manually or by any automated method.

Figure 2:
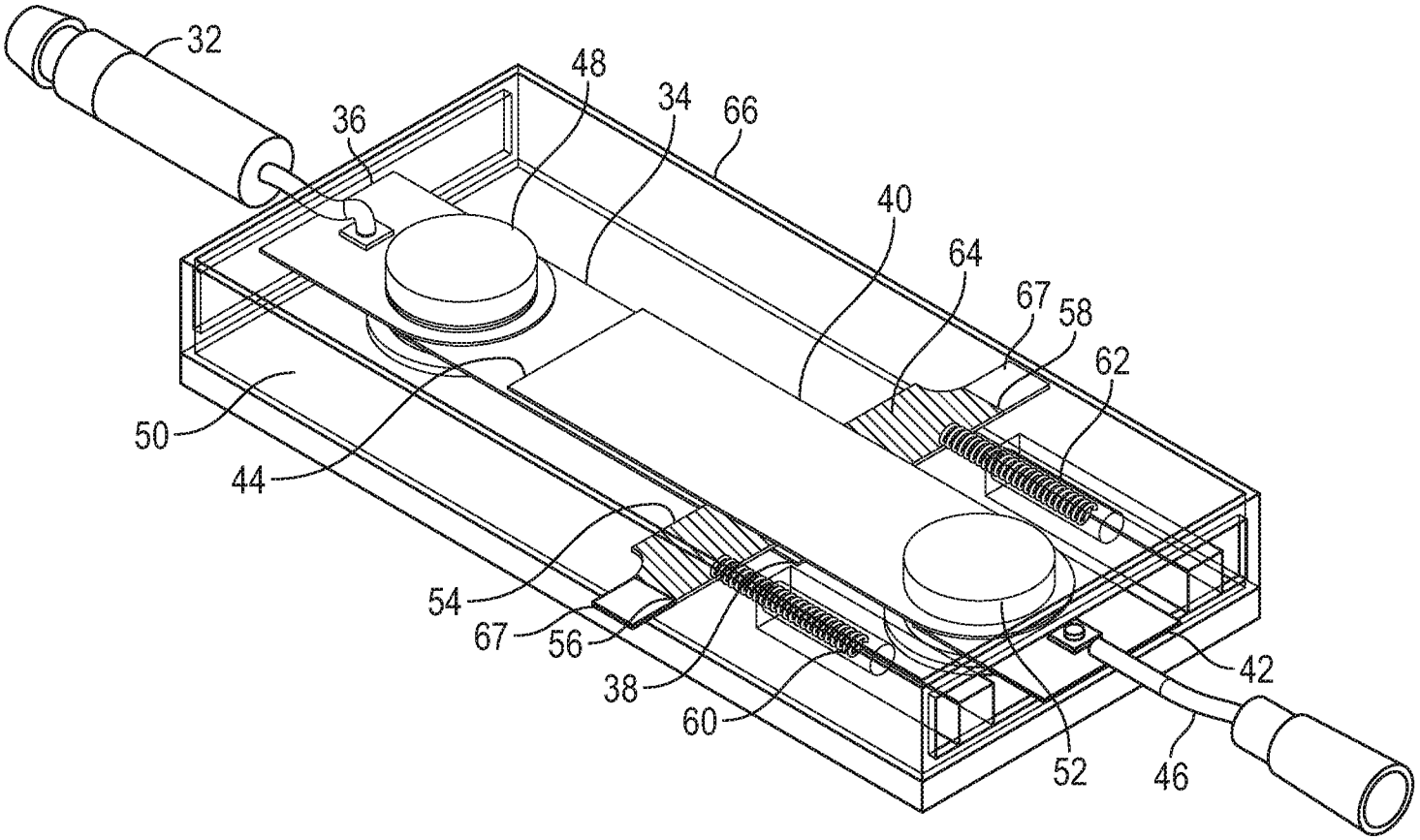
FIG. 2 illustrates a perspective see-through view of an implementation of an ignition interrupter.

Referring to FIG. 2, a perspective see-through view of an implementation of an ignition interrupter is illustrated. The ignition interrupter may include a spark plug terminal 32. As illustrated, a first conductive tab 34 may be configured to connect with the spark plug terminal 32. In various implementations, the first conductive tab 34 may have a first end 36 and a second end 38. As illustrated, the ignition interrupter may include a second conductive tab 40. In various implementations, the second conductive tab 40 may have a first end 42 and a second end 44. In various implementations, the second end 44 of the second conductive tab 40 may overlap over the second end 38 of the first conductive tab 34. In other various implementations, by non-limiting example, the first conductive tab 34 may overlap over the second conductive tab 40. The second conductive tab 40 may be configured to couple to a spark plug wire 46. A first tab holder 48 is coupled with the first conductive tab 34 and to a base 50. A second tab holder 52 is coupled with the second conductive tab 40 and to the base 50. A sled 54 is positioned between the first conductive tab 34 and the second conductive tab 40. In various implementations, the sled may be formed of high temperature resistant thermoplastic composites. In some implementations, the sled may be formed of metal that is coated with high temperature thermoplastic composites. As illustrated, the sled 54 may have a first end 56 and a second end 58. As illustrated, a first spring 60 may be coupled to the first end 56 of the sled 54, and a second spring 62 may be coupled to the second end 58 of the sled 54. The springs may be formed of materials similar to the sled high temperature resistant thermoplastics such as Polyamideimides (PAIs), High-performance polyamides (HP-PAs), Polyimides (PIs), Polyketones, Polysulfone derivatives-a, Polycyclohexane dimethyl-terephthalates (PCTs), Fluoropolymers, Polyetherimides (PEIs), Polybenzimidazoles (PBIs), Polybutylene terephthalates (PBTs), Polyphenylene sulfides, Syndiotactic polystyrene, and any others described herein.

Still referring to FIG. 2, a conductive portion 64 of the sled 54 may be in contact with the first conductive tab 34 and the second conductive tab 40 when the sled 54 is in the closed position. In various implementations, by non-limiting example, the conductive portion 64 of the sled 54 may be made of any electrically conductive material so as to allow the flow of voltage between the spark plug terminal 32 and the spark plug wire 46 by way of the first conductive tab 34, the conductive portion 64 of the sled 54, and the second conductive tab 40, when the sled 54 is in the closed position. In various implementations, as the first spring 60 and the second spring 62 are decompressed, the sled moves into the gap between the first conductive tab 34 and the second conductive tab 40, creating a space, thereby preventing the conductive portion 64 of the sled 54 to complete the path of the flow of electricity or voltage. As illustrated, the ignition interrupter may be enclosed within a molded housing 66. In various implementations, the molded housing 66 may enclose, or may be positioned around, at least the base 50, the first conductive tab 34, and the second conductive tab 40. As illustrated, the ignition interrupter may also include at least one reset tab 67. In various implementations, by non-limiting example, the reset tab 67 may be coupled to, or may be an extension of the sled 54.

Figure 3:
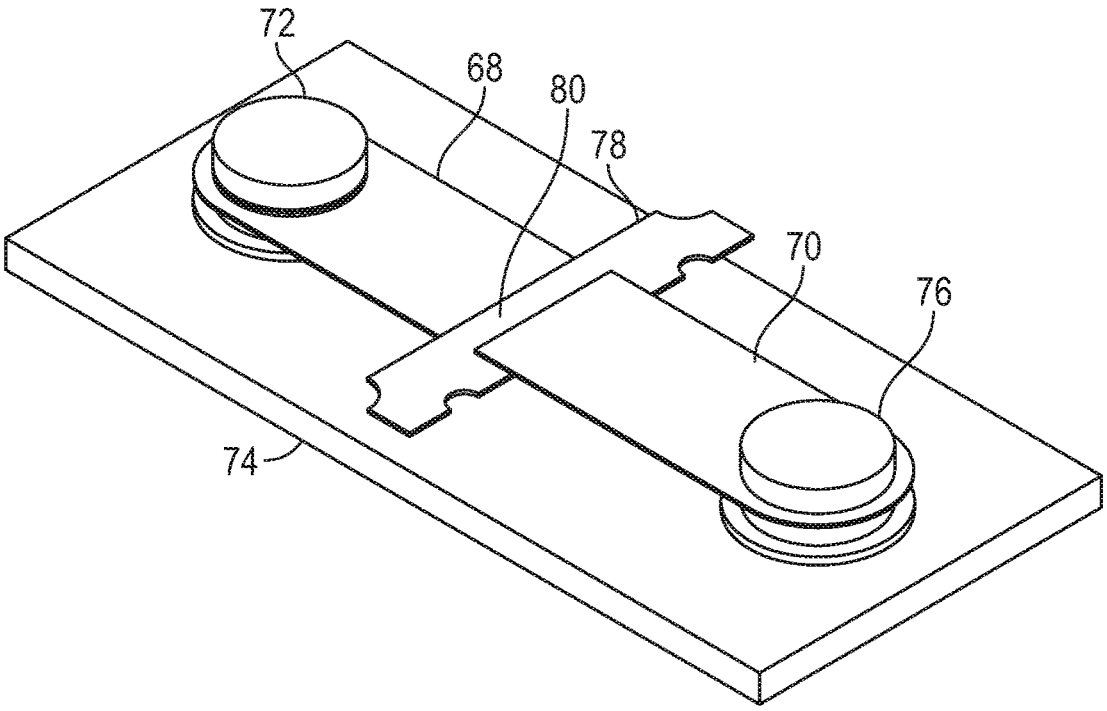
FIG. 3 illustrates an implementation of a part of an ignition interrupter in an open position.

Referring to FIG. 3, an implementation of a part of an ignition interrupter in an open position is illustrated. As illustrated, a first conductive tab 68 may be coupled to a base 74 by way of a first tab holder 72. As illustrated, a second conductive tab 70 may be coupled to the base 74 by way of a second tab holder 76. As illustrated, a sled 78 may be positioned or coupled between the first conductive tab 68 and the second conductive tab 70. In various implementations, when the sled 78 is moved along the first and second conductive tabs, a conductive portion 80 of the sled 78 interrupts the electrical connection of the first conductive tab 68 with the second conductive tab 70, when the sled 78 is in the open position. In various implementations, by non-limiting example, the sled 78 may move in any direction or fashion so as to break or interrupt the electrical connection.

Figure 4:
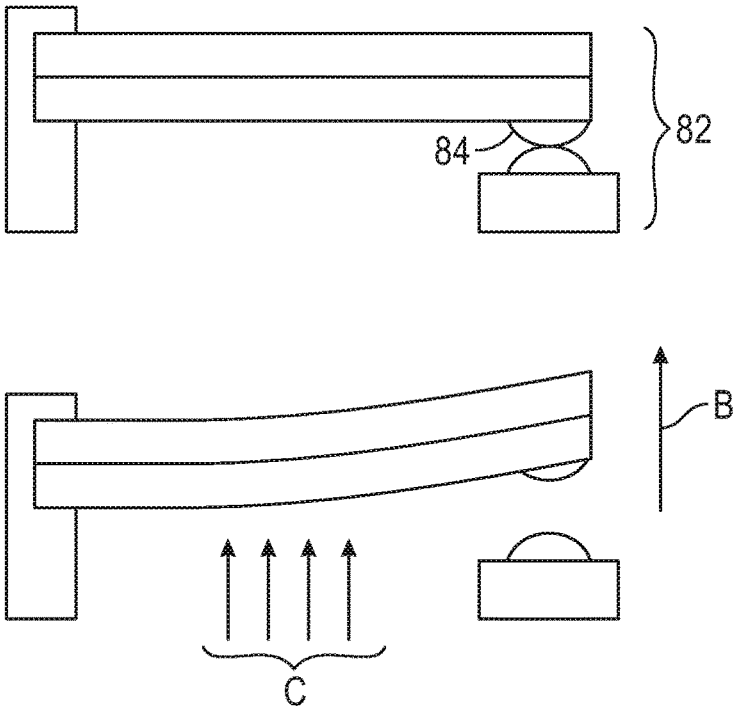
FIG. 4 illustrates an implementation of a snapdisc or a heat activated actuator.

Referring to FIG. 4, an implementation of a snapdisc or a heat activated actuator is illustrated. This implementation is a bimetallic snapdisc 82, or actuator, though other thermally sensitive systems may also be used. As illustrated in FIG. 3, when a predetermined amount of heat is applied to the snapdisc 82, or actuator, the heat shown along lines C, the snapdisc 82 may move and break the electrical connection 84, which movement or breakage is depicted along line B in FIG. 3. In particular implementations, the snapdisc 82 may release the sled or breaker when the snapdisc 82 reaches or detects a temperature of at least 180 degrees Fahrenheit. In other implementations, the sled may be released at temperatures greater than or less than 180 degrees Fahrenheit. By having an ignition interrupter that is thermally activated, with a snapdisc 82 that is made of a thermally sensitive material, temperatures ambient to a motor and/or spark plug may be controlled. Such an ignition interrupter may be a valuable safety feature for systems to ensure that the system does not overheat. Such systems may include, among others, generators or engine driven equipment, particularly those generators or engines operating in an enclosed space.

In various implementations, the snapdisc 82, or actuator, may be a thermal actuator, including, by non-limiting example, a micro-electromechanical system (MEMS) thermal actuator. The MEMS thermal actuator may generate motion by thermal expansion amplification. In other implementations, the actuator may be a push actuator. In such implementations, the push actuator may be activated once a predetermined temperature is reached. In various implementations, the actuator may initiate the breaking of the conductive path once the actuator reaches a predetermined temperature.

Figure 5:
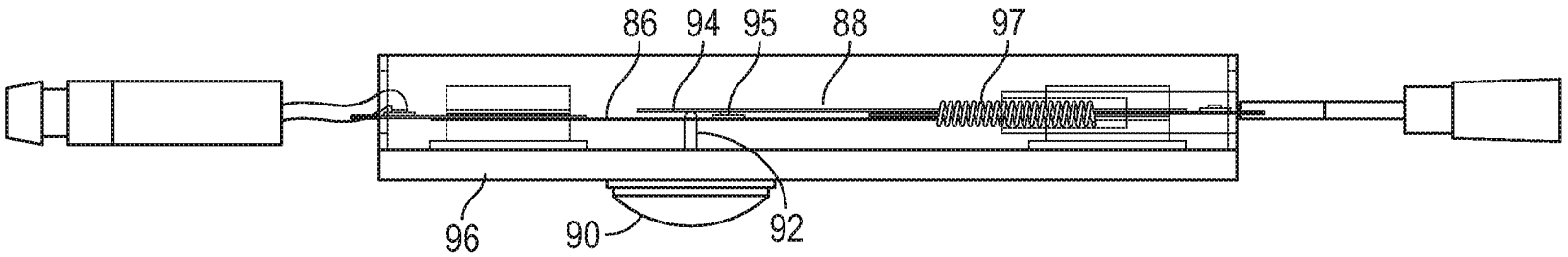
FIG. 5 illustrates a side see-through view of an implementation of an ignition interrupter with a snapdisc.

Referring to FIG. 5, a side see-through view of an implementation of an ignition interrupter with a snapdisc is illustrated. As illustrated, a second end 94 of a second conductive tab 88 overlaps over a first conductive tab 86. In various implementations, by non-limiting example, the overlapping of conductive tabs may create an electrical connection whereby voltage may flow through the ignition interrupter, or a sled 95 may be used to create a bridge between the first conductive tab 86 and the second conductive tab 88 in order to create the electrical connection and allow the flow of voltage, as previously disclosed in this document. As illustrated, the first conductive tab 86 and the second conductive tab 88 may be coupled to a base 96 of the ignition interrupter. In various implementations, by non-limiting example, the conductive tabs may be coupled, affixed, or otherwise held in place or attached to the base 96, or any other portion of the ignition interrupter, though other suitable methods. As illustrated, the ignition interrupter may also include a snapdisc 90 and a pin 92. In various implementations, the pin 92 holds the sled 95 in the closed position by holding the sled 95 against the pin 92 on one side of the sled 95, and by springs 97 on the other side of the sled 95 (also depicted in FIG. 6), allowing the flow of voltage between the first conductive tab 86 and the second conductive tab 88. In various implementations, as the springs 97 decompress, the sled 95 slides in the direction of the force of the decompressing springs 97, being moved by the springs 97, over the pin 92, thereby breaking the electrical connection, or preventing the flow of voltage, as the sled 95 is shifted into the open position. In various implementations, the pin 92 need not move a great distance to release the sled 95 into the open position. In particular implementations, the sled 95 may be released if the pin 92 is moved a 0.030 inches under the material of the sled 95. In other implementations, the pin 92 may require more or less movement than 0.030 inches to release the sled 95 into the open position.

Figure 6:
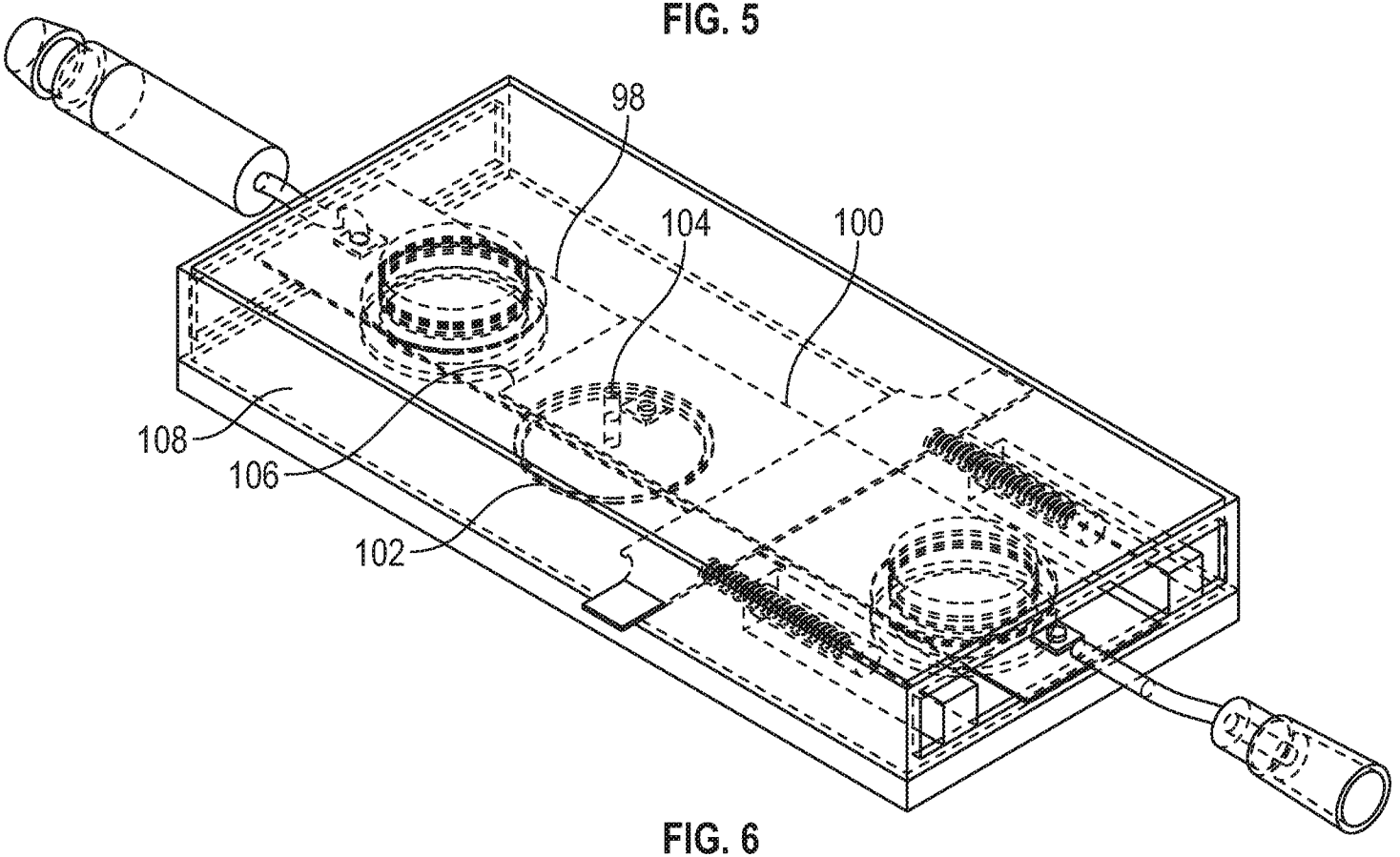
FIG. 6 illustrates a perspective see-through view of an implementation of an ignition interrupter with a snapdisc.

Referring to FIG. 6, a perspective see-through view of an implementation of an ignition interrupter with a snapdisc is illustrated. As illustrated, a second end 106 of a second conductive tab 100 overlaps with a first conductive tab 98. As illustrated, the second conductive tab 100 overlaps over the first conductive tab 98, though in other various implementations, the first conductive tab 98 may overlap over the second conductive tab 100. The ignition interrupter may include a base 108, and the conductive tabs may be coupled to the base 108. As illustrated, the ignition interrupter may also include a snapdisc 102 and a pin 104. The snapdisc 102 and the pin 104 may be positioned on a side of the base 108 opposite the first conductive tab 98 and the second conductive tab 100. In various other implementations, the snapdisc 102 and the pin 104 may be positioned on any side of the ignition interrupter.

Figure 7:
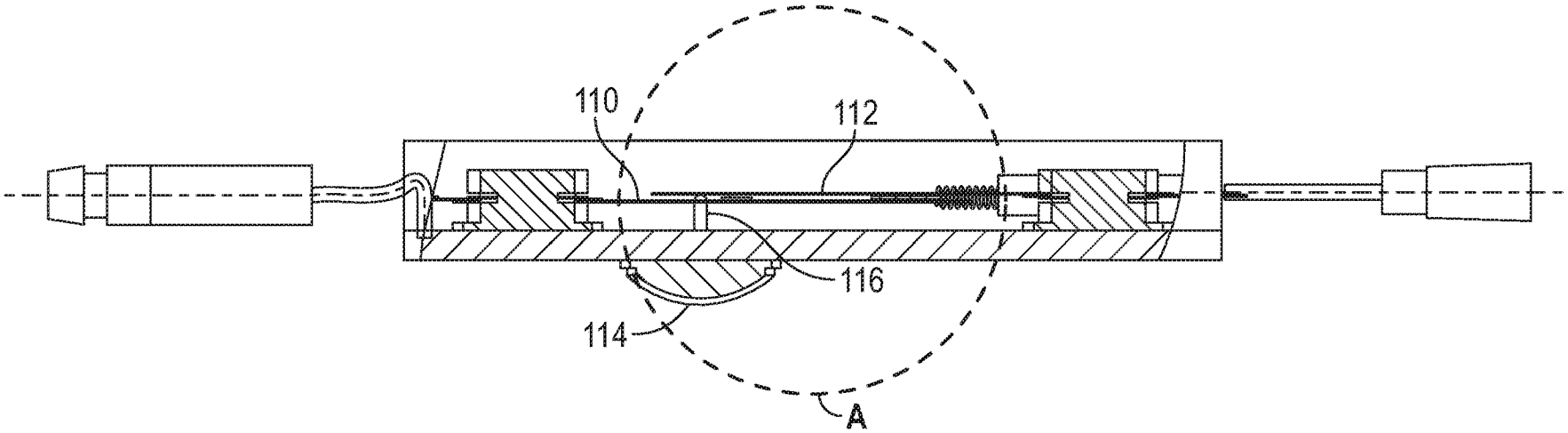
FIG. 7 illustrates a side view of an implementation of an ignition interrupter with a snapdisc.

Referring to FIG. 7, a side view of an implementation of an ignition interrupter with a snapdisc is illustrated. The ignition interrupter may include a first conductive tab 110, a second conductive tab 112, a snapdisc 114, and a pin 116. The aforementioned elements may function and be arranged, through the methods previously disclosed herein.

Figure 8:
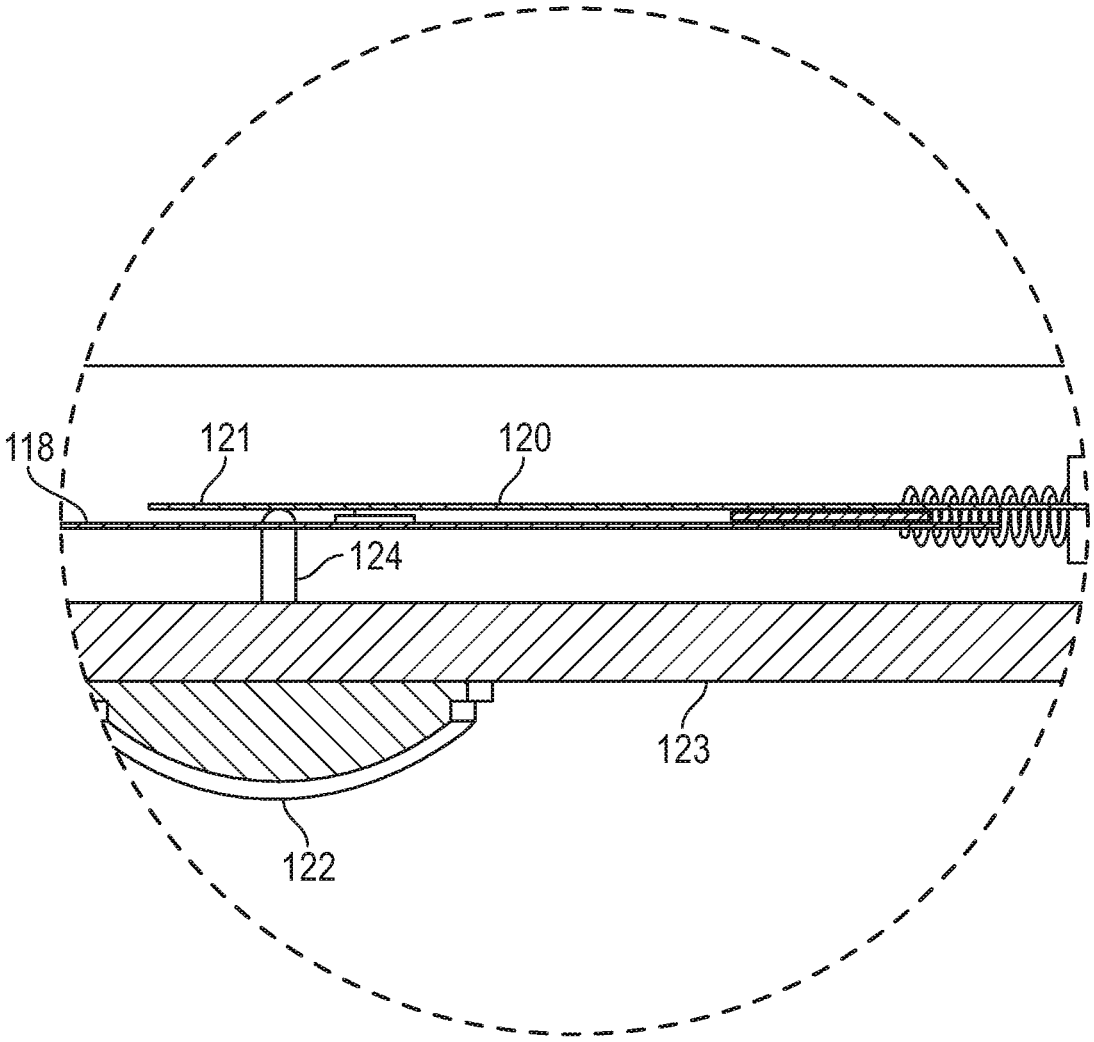
FIG. 8 illustrates a sectional view of an implementation of an ignition interrupter with a snapdisc taken along sectional line A in FIG. 7.

Referring to FIG. 8, a sectional view of an implementation of an ignition interrupter with a snapdisc taken along sectional line A in FIG. 7 is illustrated. A second conductive tab 120 overlaps with a first conductive tab 118. As illustrated, a pin 124 coupled with a snapdisc 122 extends through a base 123. The pin 124 may be coupled with a second end 121 of the second conductive tab 120. In various implementations, the pin 124 extends through an opening in the first conductive tab 118. In various implementations, the snapdisc 122 may be configured to raise the pin 124 when the snapdisc 122, or an actuator of the snapdisc 122, is exposed to a predetermined temperature or temperature threshold. In various implementations, the snapdisc 122 then creates a gap between the first conductive tab 118 and the second conductive tab 120, breaking or interrupting the flow of voltage, or any electrical connection in the open position of the ignition interrupter.

Figure 9:
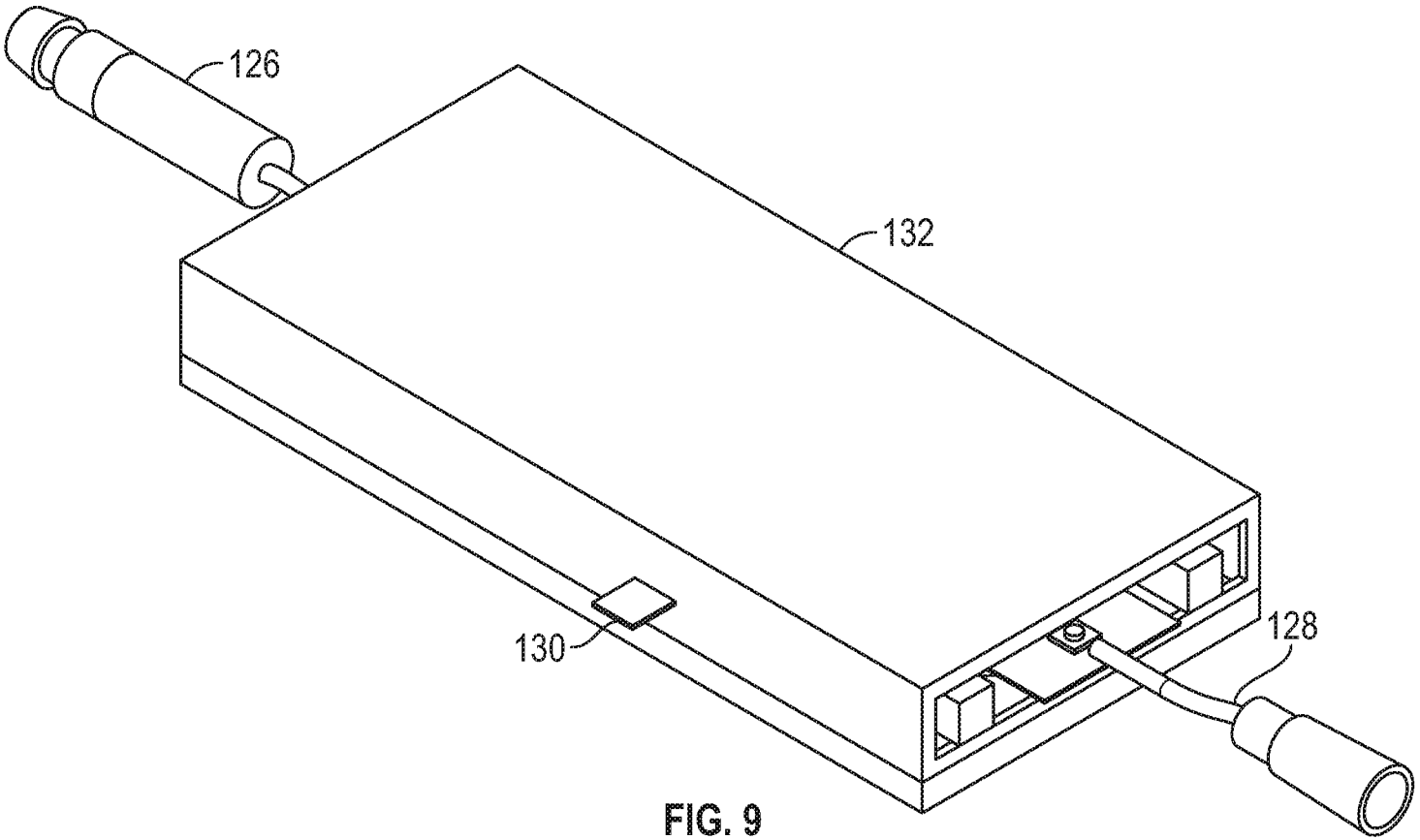
FIG. 9 illustrates a perspective view of a molded housing around an implementation of an ignition interrupter.

Referring to FIG. 9, a perspective view of a molded housing around an implementation of an ignition interrupter is illustrated. The molded housing 132 encloses the ignition interrupter. In various implementations, the molded housing 132 may enclose or be positioned around any part, or parts, of the ignition interrupter. The molded housing may be formed of, by non-limiting example, thermoplastics capable of withstanding high temperatures such as polyamideimides (PAIs), high-performance polyamides (HPPAs), polyimides (PIs), polyketones, polysulfone derivatives-a, polycyclohexane dimethyl-terephthalates (PCTs), fluoropolymers, polyetherimides (PEIs), polybenzimidazoles (PBIs), polybutylene terephthalates (PBTs), polyphenylene sulfides, syndiotactic polystyrene, polyetheretherketone (PEEK), polyphenylene sulfide (PPS), polyether imide (PEI), kapton, and other materials capable of withstanding high temperatures.

As illustrated, a spark plug terminal 126 extends out of the molded housing 132, and a spark plug wire 128 extends out of the molded housing 132 on the opposite side. In various implementations, the spark plug terminal or male portion of the spark plug may be formed of sinstered alumina in the insulator portions, Aluminum oxide and metal in the insulator tip, zinc chromate in the case/shell, and the central electrode may be formed of copper and/or nickel. In various implementations, the interrupter interrupters may be compatible with spark plugs made of other materials. Various implementations of the spark plug wire 128 may be formed of copper, nickel, other conductive metals, or any combination thereof. As illustrated, a reset tab 130 extends out of the molded housing 132 on one side. In various implementations, the reset tab 130 may be exposed outside of the molded housing 132 to allow for greater accessibility in resetting the ignition interrupter. In various implementations, the ignition interrupter may include one or more reset tabs 130 along any side of the molded housing 132 or ignition interrupter.

Figure 10:
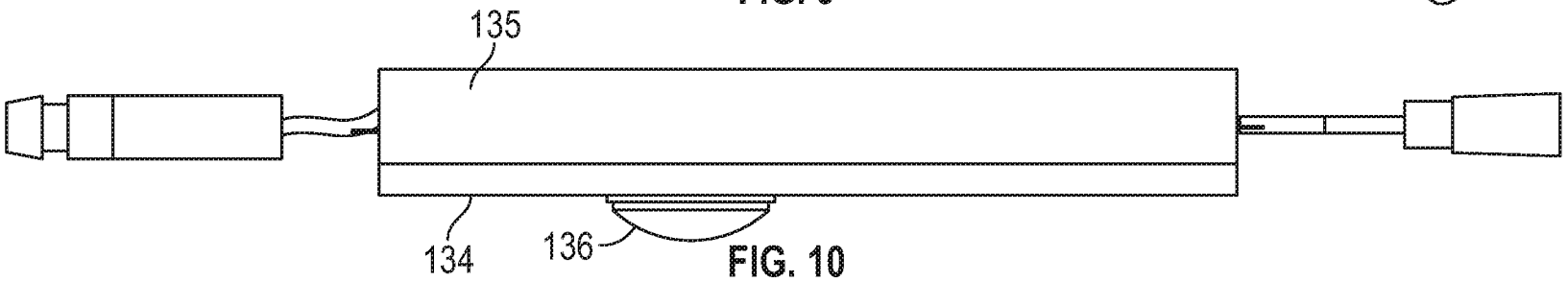
FIG. 10 illustrates a side view of a molded housing around an implementation of an ignition interrupter.

Referring to FIG. 10, a side view of a molded housing around an implementation of an ignition interrupter is illustrated. As illustrated, a base 134 of the ignition interrupter may be disposed along a bottom portion of the ignition interrupter. As illustrated, a snapdisc 136 may also be disposed along the same bottom portion of the ignition interrupter, and may extend outward from, or be exposed from, a molded housing 135. The snap disk may include various components such as an insulator, an insulator tip, a case or shell, and an electrode. In various implementations, the snap disk may be formed of materials similar to the spark plug terminal such as, by non-limiting example, aluminum metal, copper, nickel, other conductive materials used in the automotive, vehicle, and engine industries. In some implementations, the insulative portions of the snap disk may include sinstered alumina, aluminum oxide, and other insulators used in high temperature engines. In various implementations, by non-limiting example, the snapdisc 136 may be positioned along any side of the molded housing 135, and may also be enclosed by the molded housing 135.

Figure 11:
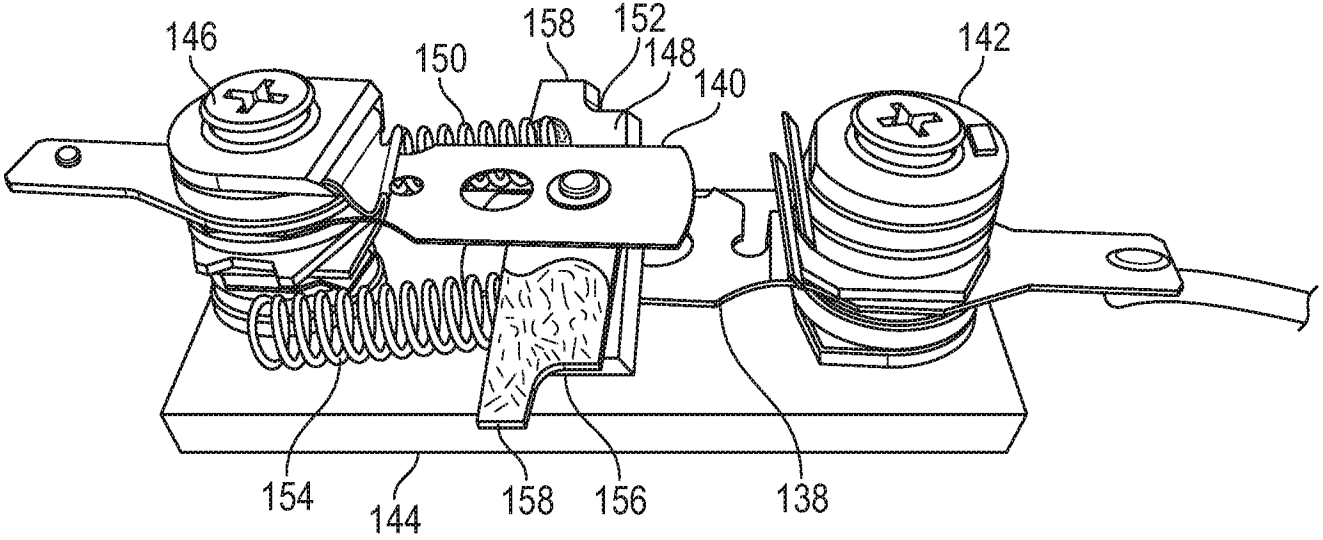
FIG. 11 illustrates a side view of an alternative implementation of an ignition interrupter.

Referring to FIG. 11, a side view of an alternative embodiment of an implementation of an ignition interrupter is illustrated. The ignition interrupter may include a first conductive tab 138 and a second conductive tab 140. In various implementations, the first conductive tab 138 may run parallel with, and overlap with, a second conductive tab 140. In other implementations, the first conductive tab 138 and the second conductive tab 140 may be positioned perpendicularly, or in any other position where they overlap, or connect at any point in order to complete an electrical connection. As illustrated, the first conductive tab 138 may be coupled to a base 144 by a first tab holder 142, and the second conductive tab 140 may be coupled to the base 144 by a second tab holder 146. In various implementations, the first conductive tab 138 and the second conductive tab 140 may be held in place by any other method of attachment or coupling, including coupling directly with the base 144.

Still referring to FIG. 11, the ignition interrupter may include a sled 148. In various implementations, the sled 148 may include a first end 152 and a second end 156. As illustrated, the sled 148 may be positioned substantially perpendicular to a plane of the first conductive tab 138 and the second conductive tab 140. As illustrated, the sled 148 may be coupled between the first conductive tab 138 and the second conductive tab 140. In various implementations, the sled 148 may be configured to move along a plane parallel with the first conductive tab 138 and the second conductive tab 140 to an open position in a gap between the first conductive tab 138 and the second conductive tab 140, decompressing a first spring 150 and a second spring 154. In various implementations, the movement of the sled 148 to the open position may break an electrical connection between the first conductive tab 138 and the second conductive tab 140, by creating a gap between the first conductive tab 138 and the second conductive tab 140, thereby preventing the flow of voltage through the ignition interrupter. In various implementations, the first conductive tab 138 and the second conductive tab 140, when touching, may allow the flow of voltage between the first conductive tab 138 and the second conductive tab 140, when the sled 148 is in a closed position, and there is no gap between them. In various implementations, when the sled 148 is moved to the closed position, the first spring 150 and the second spring 154 may be compressed.

Still referring to FIG. 11, as illustrated, the ignition interrupter may include at least one, or more, reset tabs 158. In various implementations, by non-limiting example, the reset tab 158 may be coupled to the sled 148, on a first end 152 of the sled 148, and/or on a second end 156 of the sled 148, or on any other location on or along the sled 148. In various implementations, the reset tab 158 may be configured to move the sled 148 to the closed position out of the gap between the first conductive tab 138 and the second conductive tab 140, where the movement compresses the first spring 150 and the second spring 154. In various implementations, the reset tab 158 may be used to reset the ignition interrupter, or to move the sled 148 back into the closed position after the system has been triggered to break the electrical connection, thereby restoring the flow, or the ability of the electricity to flow, between the first conductive tab 138 and the second conductive tab 140. In this way, the same ignition interrupter may be used multiple times, even after it has been triggered to break the electrical connection and move to the open position. In various implementations, by non-limiting example, the reset tab 158 may be triggered, moved, or caused to move, manually or by any automated method.

Figure 12:
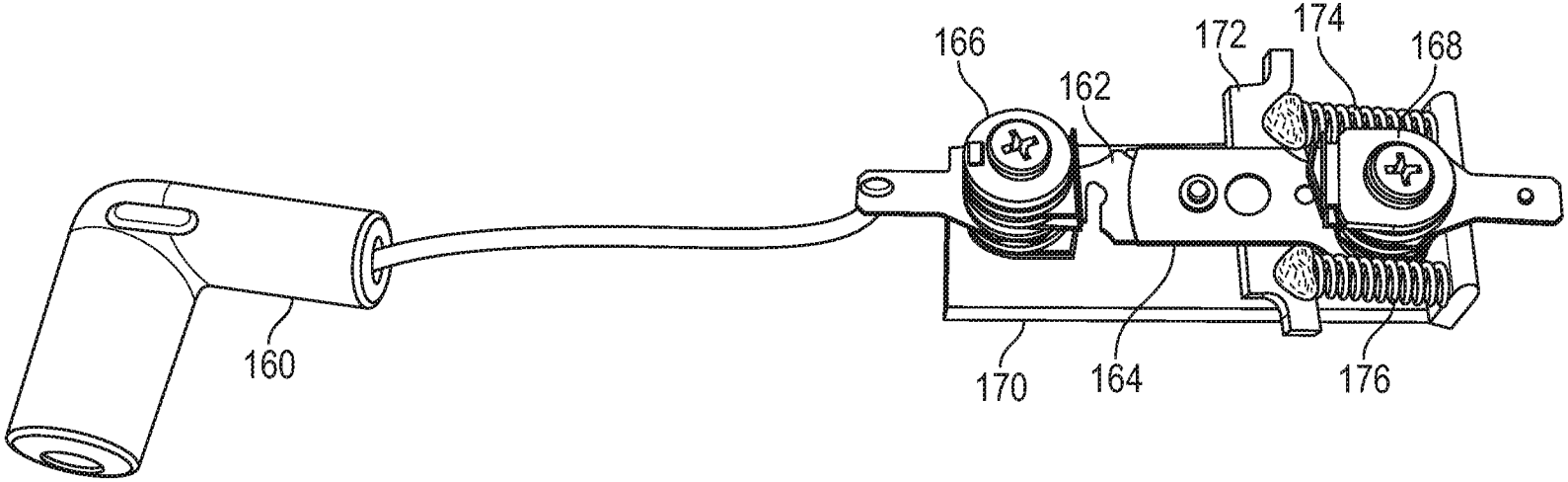
FIG. 12 illustrates a top view of the alternative implementation of an ignition interrupter.

Referring to FIG. 12, a top view of the alternative implementation of an ignition interrupter FIG. 11 is illustrated. The ignition interrupter may include a spark plug terminal 160. As illustrated, a first conductive tab 162 may be configured to connect with the spark plug terminal 160. As illustrated, the ignition interrupter may include a second conductive tab 164. In various implementations, the second conductive tab 164 may overlap over the first conductive tab 162. In other various implementations, by non-limiting example, the first conductive tab 162 may overlap over the second conductive tab 164. As illustrated, a first tab holder 166 may couple the first conductive tab 162 to a base 170. A second tab holder 168 may couple the second conductive tab 164 to the base 170. As illustrated, a sled 172 may be positioned between the first conductive tab 162 and the second conductive tab 164. As illustrated, a first spring 174 may be coupled to the sled 172, and a second spring 176 may be coupled to an opposite end of the sled 172.

Figure 13:
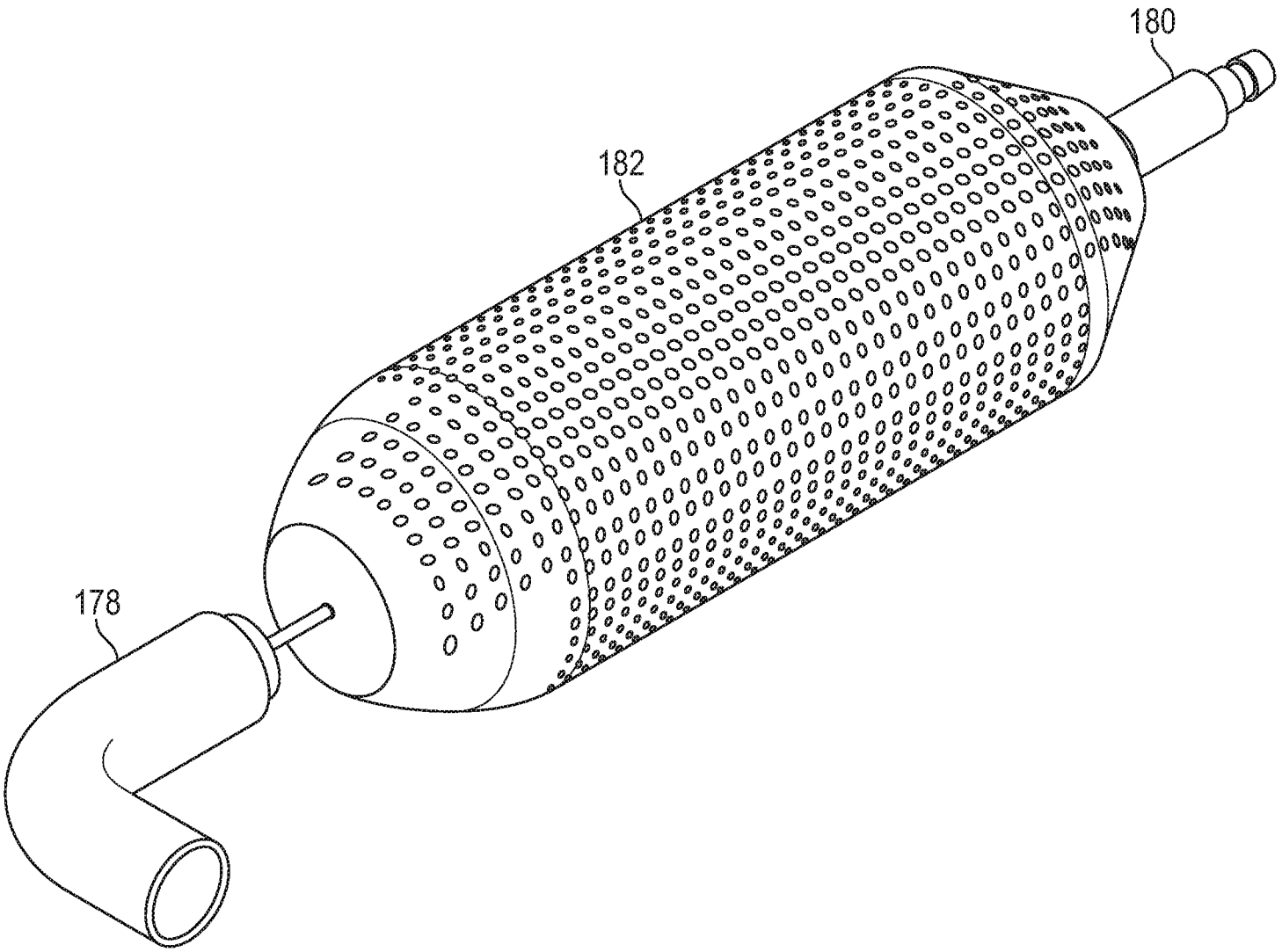
FIG. 13 illustrates a perspective view of an another alternative implementation of an ignition interrupter.

Referring to FIG. 13, a perspective view of an alternative embodiment of an implementation of an ignition interrupter is illustrated. The ignition interrupter may include a spark plug terminal 178 and spark plug wire 180 similar to, or the same as, any spark plug terminal and spark plug wire previously disclosed herein. As illustrated, the ignition interrupter may be enclosed within a molded housing 182. In various implementations, by non-limiting example, the molded housing 182 may fully enclose, or at least partially enclose, the ignition interrupter.

Figure 14:
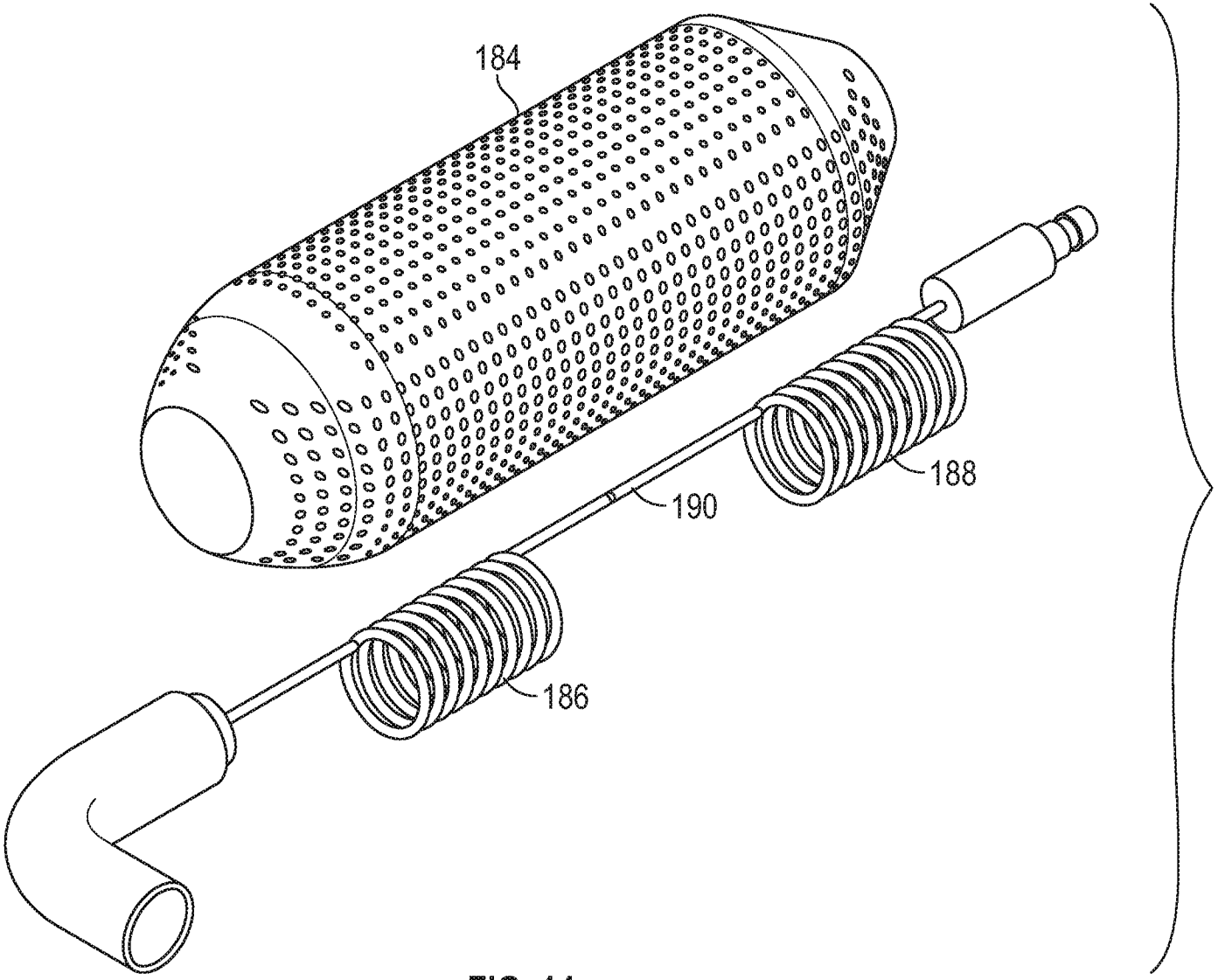
FIG. 14 illustrates a perspective view of the alternative implementation of an ignition interrupter with a coiled section in FIG. 13.

Referring to FIG. 14, a perspective view of the alternative embodiment in FIG. 13 of an implementation of an ignition interrupter with a coiled section is illustrated. As illustrated, a conductive portion 190 or channel of the ignition interrupter may include one or more coiled sections that act as a spring with a first spring 186 and a second spring 188. In various implementations, a soldered portion may be included in the conductive portion 190. In various implementations, when the ambient air reaches a predetermined temperature, the solder portion may break and the one or more springs may break the conductive portion 190 to the open position, and interrupt the flow of voltage through the ignition interrupter. As illustrated, the ignition interrupter may be enclosed or housed within a molded housing 184.

In places where the description above refers to particular implementations of ignition interrupters and implementing components, sub-components, methods and sub-methods, it should be readily apparent that a number of modifications may be made without departing from the spirit thereof and that these implementations, implementing components, sub-components, methods and sub-methods may be applied to other ignition interrupters.

What is claimed is:

1. A system of interrupting ignition, comprising:

a first conductive tab comprising a first end and a second end, the first end configured to couple to a spark plug;

a second conductive tab comprising a first end and a second end, the first end configured to couple to a spark plug wire;

a first tab holder coupled with the first end of the first conductive tab, the first tab holder coupled to a base;

a second tab holder coupled with the first end of the second conductive tab, the second tab holder coupled to the base, wherein a second end of the second conductive tab overlaps with the second end of the first conductive tab;

a sled comprising a first end and a second end, the sled positioned substantially perpendicular to a plane of the first conductive tab and the second conductive tab, the sled coupled between the first conductive tab and the second conductive tab;

a first spring coupled to the first end of the sled; and a second spring coupled to the second end of the sled;

wherein the sled is configured to move to an open position in a gap between the first conductive tab and the second conductive tab, decompressing the first spring and the second spring.

2. The system of claim 1, further comprising:

a snapdisc comprised on a side of the base opposite the first tab holder and the second tab holder; and a pin coupled with the snapdisc extending through the base, the pin coupled with the second end of the second conductive tab, the pin extending through an opening in the first conductive tab;

wherein the snapdisc is configured to raise the pin when exposed to a predetermined temperature, the snapdisc creating the gap between the first conductive tab and the second conductive tab.

3. The system of claim 1, wherein the sled is configured to move to a closed position out of the gap between the first conductive tab and the second conductive tab, compressing the first spring and the second spring.

4. The system of claim 3, wherein a conductive portion of the sled electrically connects the first conductive tab with the second conductive tab when the sled is in the closed position.

5. The system of claim 1, further comprising a reset tab coupled to the sled, wherein the reset tab is configured to move the sled to a closed position out of the gap between the first conductive tab and the second conductive tab, compressing the first spring and the second spring.

6. The system of claim 1, further comprising a molded housing, the molded housing comprised around at least the base, the first conductive tab, and the second conductive tab.

7. A system for interrupting ignition, comprising:

a first conductive tab comprising a first end and a second end, the first end configured to couple to a spark plug;

a second conductive tab comprising a first end and a second end, the first end configured to couple to a spark plug wire;

a first tab holder coupled with the first end of the first conductive tab, the first tab holder coupled to a base;

a second tab holder coupled with the first end of the second conductive tab, the second tab holder coupled to the base, wherein a second end of the second conductive tab overlaps with the second end of the first conductive tab;

a snapdisc comprised on a side of the base opposite the first tab holder and the second tab holder;

a pin coupled with the snapdisc extending through the base, the pin coupled with the second end of the second conductive tab, the pin extending through an opening in the first conductive tab;

a sled comprising a first end and a second end, the sled positioned substantially perpendicular to a plane of the first conductive tab and the second conductive tab, the sled coupled between the first conductive tab and the second conductive tab;

a first spring coupled to the first end of the sled; and a second spring coupled to the second end of the sled;

wherein the snapdisc is configured to raise the pin when exposed to a predetermined temperature, the snapdisc creating a gap between the first conductive tab and the second conductive tab; and wherein the sled is configured to move to an open position in the gap between the first conductive tab and the second conductive tab, decompressing the first spring and the second spring.

8. The system of claim 7, wherein the sled is configured to move to a closed position out of the gap between the first conductive tab and the second conductive tab, compressing the first spring and the second spring.

9. The system of claim 8, wherein a conductive portion of the sled electrically connects the first conductive tab with the second conductive tab when the sled is in the closed position.

10. The system of claim 7, further comprising a reset tab coupled to the sled, wherein the reset tab is configured to move the sled to a closed position out of the gap between the first conductive tab and the second conductive tab, compressing the first spring and the second spring.

11. The system of claim 7, further comprising a molded housing, the molded housing comprised around at least the base, the first conductive tab, and the second conductive tab.

12. The system of claim 7, wherein the snapdisc is comprised of a thermally sensitive material.

13. A system of interrupting ignition, comprising:

a first conductive tab comprising a first end and a second end, the first end configured to couple to a spark plug;

a second conductive tab comprising a first end and a second end, the first end configured to couple to a spark plug wire;

a first tab holder coupled with the first end of the first conductive tab, the first tab holder coupled to a base;

a second tab holder coupled with the first end of the second conductive tab, the second tab holder coupled to the base, wherein a second end of the second conductive tab overlaps with the second end of the first conductive tab;

a sled comprising a first end and a second end, the sled positioned substantially perpendicular to a plane of the first conductive tab and the second conductive tab, the sled coupled between the first conductive tab and the second conductive tab;

a first spring coupled to the first end of the sled;

a second spring coupled to the second end of the sled; and a reset tab coupled to the sled;

wherein the reset tab is configured to move the sled to a closed position out of a gap between the first conductive tab and the second conductive tab, compressing the first spring and the second spring; and wherein the sled is configured to move to an open position in the gap between the first conductive tab and the second conductive tab, decompressing the first spring and the second spring.

14. The system of claim 13, further comprising:

a snapdisc comprised on a side of the base opposite the first tab holder and the second tab holder; and a pin coupled with the snapdisc extending through the base, the pin coupled with the second end of the second conductive tab, the pin extending through an opening in the first conductive tab;

wherein the snapdisc is configured to raise the pin when exposed to a predetermined temperature, the snapdisc creating the gap between the first conductive tab and the second conductive tab.

15. The system of claim 13, wherein the sled is configured to move to a closed position out of the gap between the first conductive tab and the second conductive tab, compressing the first spring and the second spring.

16. The system of claim 15, wherein a conductive portion of the sled electrically connects the first conductive tab with the second conductive tab when the sled is in the closed position.

17. The system of claim 13, further comprising a molded housing, the molded housing comprised around at least the base, the first conductive tab, and the second conductive tab.

* * * * *